US011339528B2

(12) United States Patent
Brennan et al.

(10) Patent No.: US 11,339,528 B2
(45) Date of Patent: May 24, 2022

(54) MAT WASHER

(71) Applicant: Well Service Group, Inc., Blairsville, PA (US)

(72) Inventors: Richard J. Brennan, Coraopolis, PA (US); William R. Woessner, III, McKees Rocks, PA (US)

(73) Assignee: Well Service Group Inc., Blairsville, PA (US)

( * ) Notice: Subject to any disclaimer, the term of this patent is extended or adjusted under 35 U.S.C. 154(b) by 252 days.

(21) Appl. No.: 15/494,004

(22) Filed: Apr. 21, 2017

(65) Prior Publication Data

US 2018/0155866 A1 Jun. 7, 2018

Related U.S. Application Data

(60) Provisional application No. 62/430,615, filed on Dec. 6, 2016.

(51) Int. Cl.

| | |
|---|---|
| ***B08B 1/00*** | (2006.01) |
| ***B08B 1/02*** | (2006.01) |
| ***B08B 1/04*** | (2006.01) |
| ***B08B 3/02*** | (2006.01) |
| ***B08B 7/04*** | (2006.01) |
| ***D06G 1/00*** | (2006.01) |

(52) U.S. Cl.

CPC ..... *D06G 1/00* (2013.01); *B08B 1/002* (2013.01); *B08B 1/02* (2013.01); *B08B 1/04* (2013.01); *B08B 3/022* (2013.01); *B08B 7/04* (2013.01)

(58) Field of Classification Search

CPC .. B08B 1/002; B08B 1/02; B08B 1/04; B08B 3/022; B08B 7/04; D06G 1/00

USPC ..... 134/122 R

See application file for complete search history.

(56) References Cited

U.S. PATENT DOCUMENTS

| | | | | |
|---|---|---|---|---|
| 4,118,958 | A * | 10/1978 | Lemon | D06F 31/00 68/205 R |
| 8,227,566 | B2 | 10/2012 | Rubenzer et al. | |
| 2011/0017245 | A1 | 1/2011 | Vernon et al. | |
| 2014/0014143 | A1* | 1/2014 | Kennedy | B08B 1/002 134/115 R |

* cited by examiner

*Primary Examiner* — Levon J Shahinian
(74) *Attorney, Agent, or Firm* — The Webb Law Firm

(57) ABSTRACT

A mat washer is disclosed which includes a mainframe, a rail surface affixed to the mainframe at an angle of 25 degrees to 90 degrees, a conveying system adapted to transport one or more mats along the rail surface, an enclosed washing chamber having one or more spray bars adapted to direct jets of water at each mat, a discharge wheel adapted for stacking each mat onto a discharge rack, a water recycling system having a waste conveyor adapted to separate large debris from water, the water recycling system have one or more filtration devices adapted to separate small debris from water, and a high pressure pump to supply water under pressure to the one or more spray bars.

13 Claims, 13 Drawing Sheets

MAT WASHER

CROSS-REFERENCE TO RELATED APPLICATIONS

This application claims the benefit of U.S. Provisional Patent Application No. 62/430,615, filed Dec. 6, 2016 and entitled "Mat Washer", which is hereby incorporated by reference in its entirety.

BACKGROUND OF THE INVENTION

Field of the Invention

This invention relates generally to devices for washing mats. Particularly, the invention relates to automated devices for cleaning and washing mats which are used in services including, but not limited to, well site construction, power transmission, pipeline, construction, military, entertainment, and utilities.

Description of Related Art

Interlocking mats are used to provide a safe and stable working surface for jobsite personnel and machinery. Such mats may be designed to mechanically attach to one another. For example, mats may have a lip around their perimeter such that the lips of mats laid adjacent to one another form an overlapping joint. Additionally, adjacent mats may have interlocking knobs and holes to secure the adjacent mats to one another.

In addition to providing a safe, stable working surface, the mats serve to protect the underlying soil from erosion due to the use of heavy machinery, and from contamination due to jobsite spills. Thus, jobsite mats play an important environmental role in preserving the integrity of the underlying soil and expediting the reclamation of jobsites.

Mats must be routinely cleaned to maintain safe conditions of the working surface. Mats must also be cleaned prior to transport between jobsites to prohibit the spread of invasive species which may adhere to the surfaces of the mats.

Mat washing is typically performed manually using a pressure washer, often in unsafe and hazardous conditions. Manual washing is slow and tedious, the lack of a recirculation system wastes a considerable amount of water, and washing time is unpredictable based on environmental conditions and the severity of debris built up on the mats. More importantly, manual washing is extremely unsafe to workers as workers are routinely required to work in slippery conditions near and sometimes under mats in unforgiving environmental conditions, such as ice, snow, and heat. Thus, a more efficient, safer, and less water-intensive alternative is needed.

Automated mat washers are known in the art of wooden mats which are used to provide temporary roadways over which construction equipment travels. U.S. Pat. No. 8,277,566 to Rubenzer et al. discloses one such mat washing machine for wooden mats used at construction sites. The mat washing machine consists of a portable structure including at least one conveying system which transports construction site mats through at least one brush system. The mat washer further includes a rail system to keep the mats in an upright position as they are conveyed through the portable structure, a water recycling system to reduce the amount of water required for cleaning the mats, and an automation system to reduce the amount of time required to clean the mats.

U.S. Patent Publication No. 2011/0017245 to Vernon et al. discloses an apparatus for washing temporary road mats including a washing chamber and an automated conveyor assembly for feeding the mats through the washing chamber. The washing chamber includes a plurality of tines for scraping debris off of the mats, a spray bar system for directing liquid under pressure at the mats, and a water reclamation system for filtering and recycling the liquid.

SUMMARY OF THE INVENTION

It is an object of the present invention to provide an apparatus and method for washing mats which may be substantially automated such that the manpower and time required to wash mats is reduced.

It is a further object of the present invention to provide a mat washer which reduces the amount of water required by traditional, manual methods of mat washing.

It is a further object of the present invention to provide a mat washer which is of dimensions readily suitable for transport by a tractor-trailer. That is, it is an object of the present invention to provide a mat washer which requires no special permits to transport from jobsite to jobsite.

The present invention relates to a mat washer which includes a mainframe; a rail surface affixed to the mainframe at an angle of 25 degrees to 90 degrees; a conveying system affixed to the mainframe, the conveying system adapted to convey each of the one or more mats along the rail surface; a washing chamber affixed to the mainframe, the washing chamber at least partially enclosing the rail surface such that the conveying system conveys each of the one or more mats through the washing chamber; one or more spray bars disposed within the washing chamber, each of the one or more spray bars having a plurality of nozzles adapted to direct jets of water at each of the one or more mats conveyed through the washing chamber; a water recycling system disposed in the mainframe adapted to collect runoff from the washing chamber, the water recycling system having a waste conveyor adapted to separate large debris from water, the water recycling system have one or more filtration devices adapted to separate small debris from water; and a high pressure pump disposed between the one or more filtration devices and the one or more spray bars, the high pressure pump supplying water under pressure to the one or more spray bars.

In another non-limiting embodiment, the mat washer further includes an oil-water separator having a plurality of parallel plates adapted to inhibit a flow of oil particles, causing said oil particles to float to a water surface; and an oil skimmer having an endless tube which cycles across the water surface, removes said oil particles from the water surface, and deposits said oil particles into a waste oil bin.

In a non-limiting embodiment, the mat washer further includes one or more boilers through which water exiting the one or more filtration devices is pumped and in which water is heated to a washing temperature.

In another non-limiting embodiment, the mat washer further includes one or more brush assemblies disposed within the washing chamber, each of the one or more brush assemblies having a rotating drum brush adapted to scrub a surface of each of the one or more mats.

In another non-limiting embodiment, the mainframe of the mat washer is composed of a plurality of modular skids such that the mainframe of the mat washer may be disassembled and transported in sections.

In another non-limiting embodiment, the rail surface is lined with a low-friction, wear-resistant material, for example, ultra high molecular weight polyethylene (UHMW).

In another non-limiting embodiment, the mat washer is controlled via a remote control positioned in a cabin of a front-end loader to further reduce the manpower required to operate the mat washer.

The present invention also relates to a method for washing mats which includes the steps of loading one or more mats onto a receiving rack; conveying the one or more mats, one at a time, through a washing chamber; directing a plurality of jets of heated, pressurized water from one or more spray bars at the one or more mats to remove debris from the one or more mats; directing the water and debris into a water recycling system, wherein the debris is substantially separated from the water and the debris is discarded; pumping the water at a washing temperature to the one or more spray bars; and depositing the one or more mats onto a discharge rack.

BRIEF DESCRIPTION OF THE DRAWING(S)

DESCRIPTION OF THE INVENTION

Figure 1:
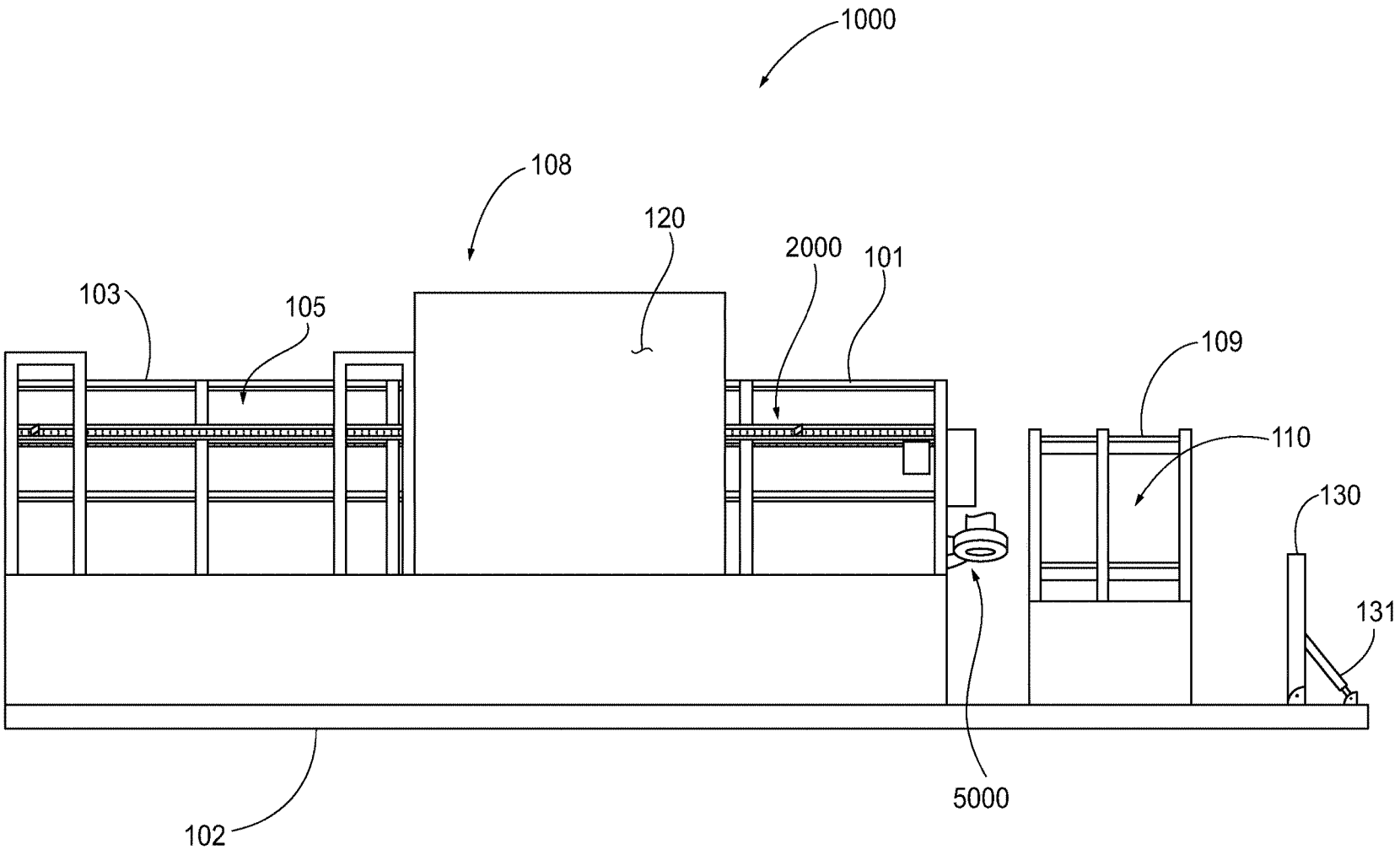
FIG. 1 is a front view of a mat washer according to an embodiment of the present invention.

For the purposes of the description hereinafter, the terms "upper", "lower", "right", "left", "vertical", "horizontal", "top", "bottom", "side", "front", "back", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and physical characteristics related to the embodiments disclosed herein are not to be considered as limiting. As used throughout the drawings, like reference numerals refer to like components or method steps unless otherwise indicated.

Figure 2:
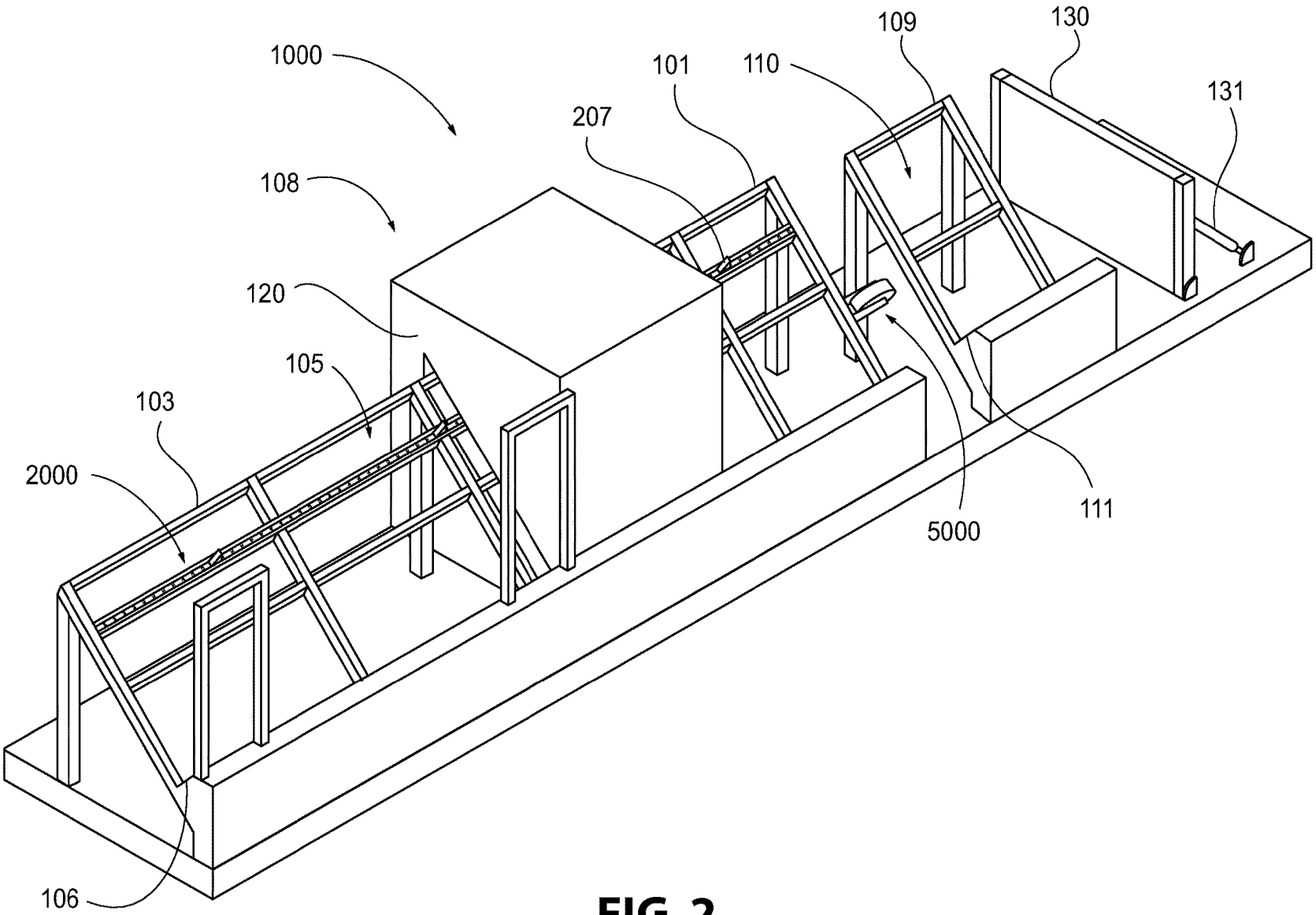
FIG. 2 is a perspective view of the mat washer of FIG. 1.
Figure 3:
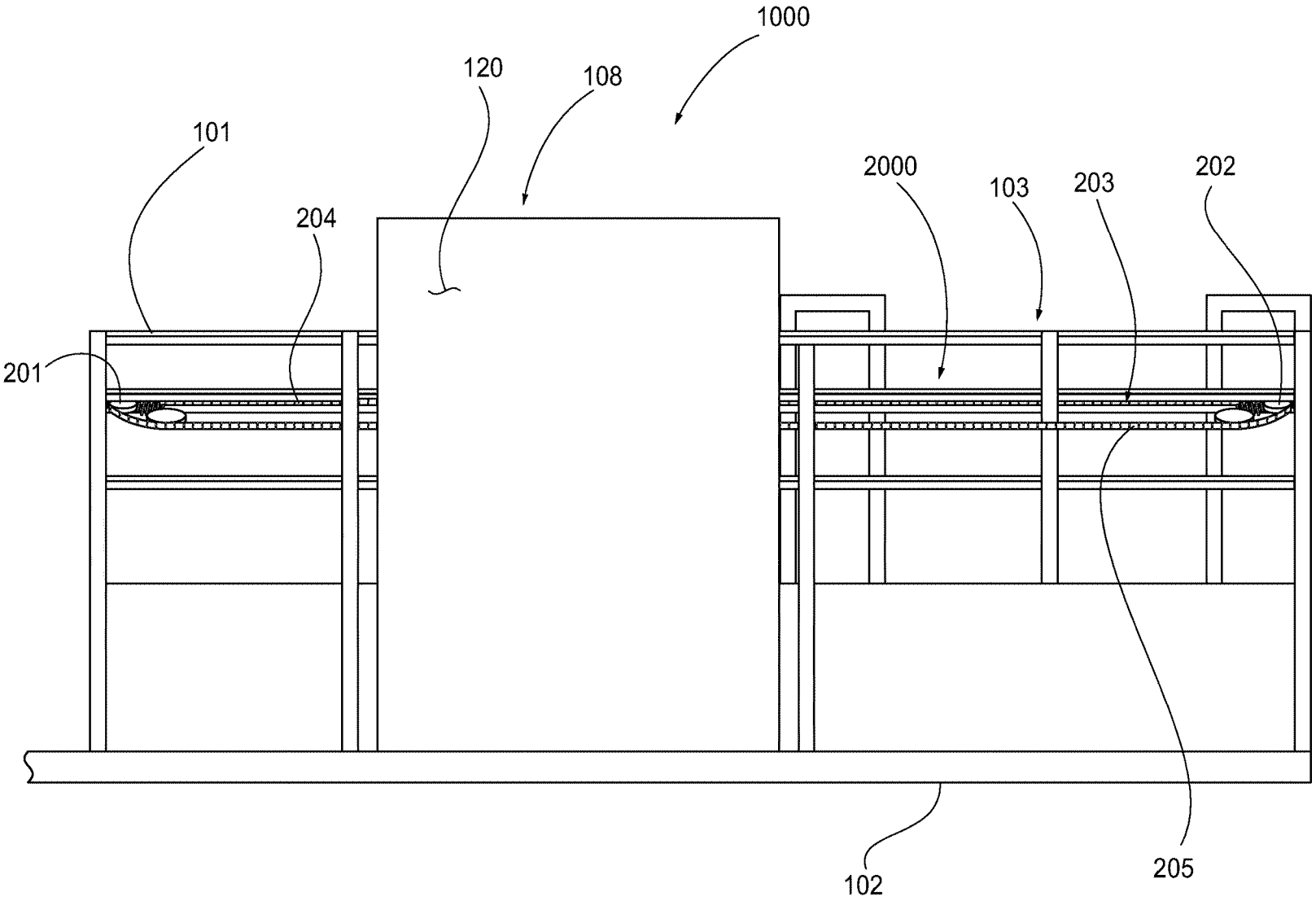
FIG. 3 is a rear view of the conveying system and washing chamber of the mat washer of FIG. 1.

Referring now to FIGS. 1-3, a mat washer 1000 according to an embodiment of the present invention includes a mainframe 101 which provides the structural support for the mat washer 1000 and serves as an attachment point for the other components and assemblies described herein. In a non-limiting embodiment, the mainframe 101 is constructed from a modular skid 102 so that the mat washer 1000 may be transported, for example, on a flatbed trailer. The modular skid 102 may be fabricated to a length, a width, and a height such that transportation of the mat washer 1000 via truck does not require oversized load permits.

Figure 11:
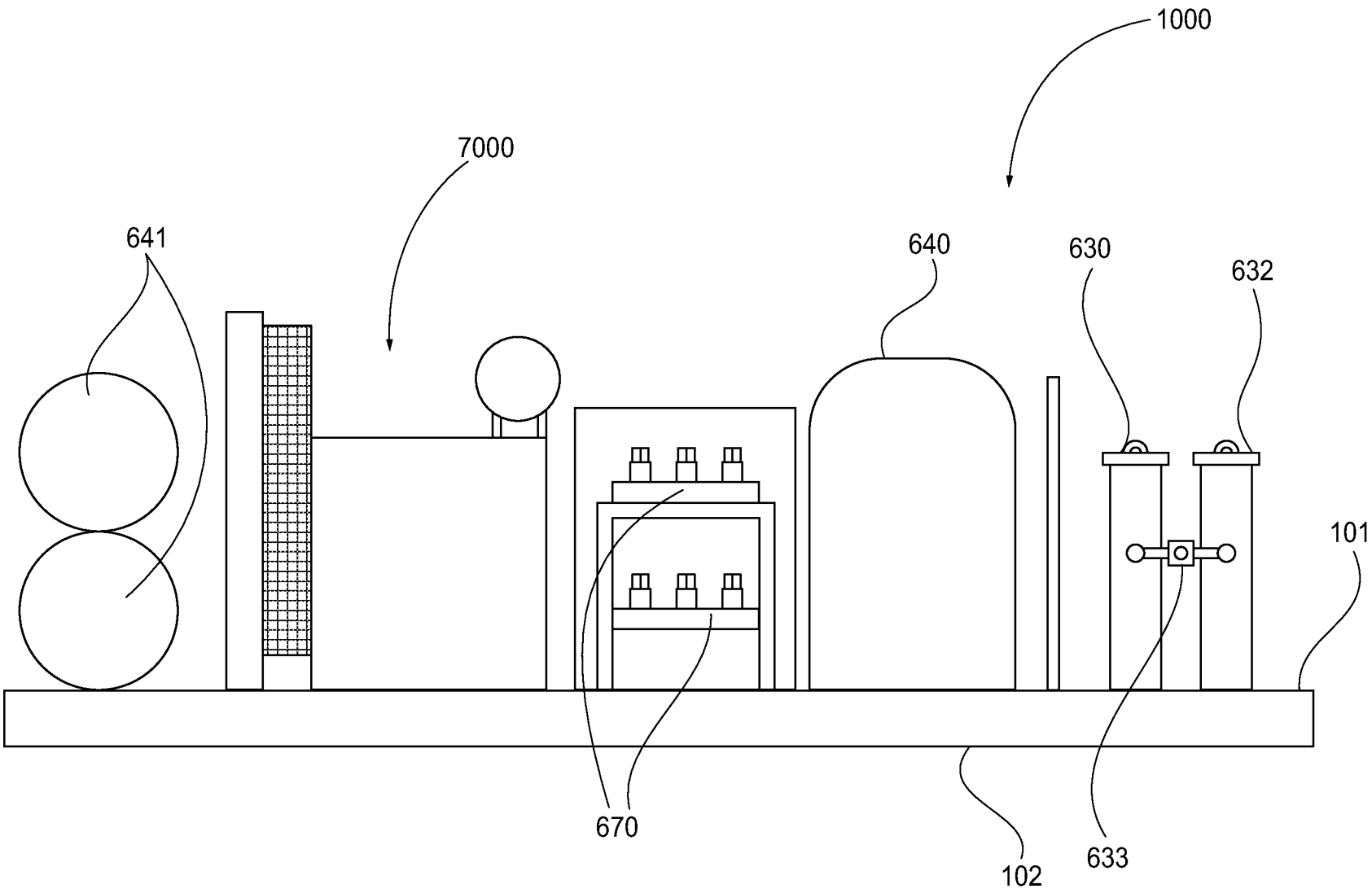
FIG. 11 is a front view of another portion of the water recycling system of the mat washer of FIG. 1.
Figure 12:
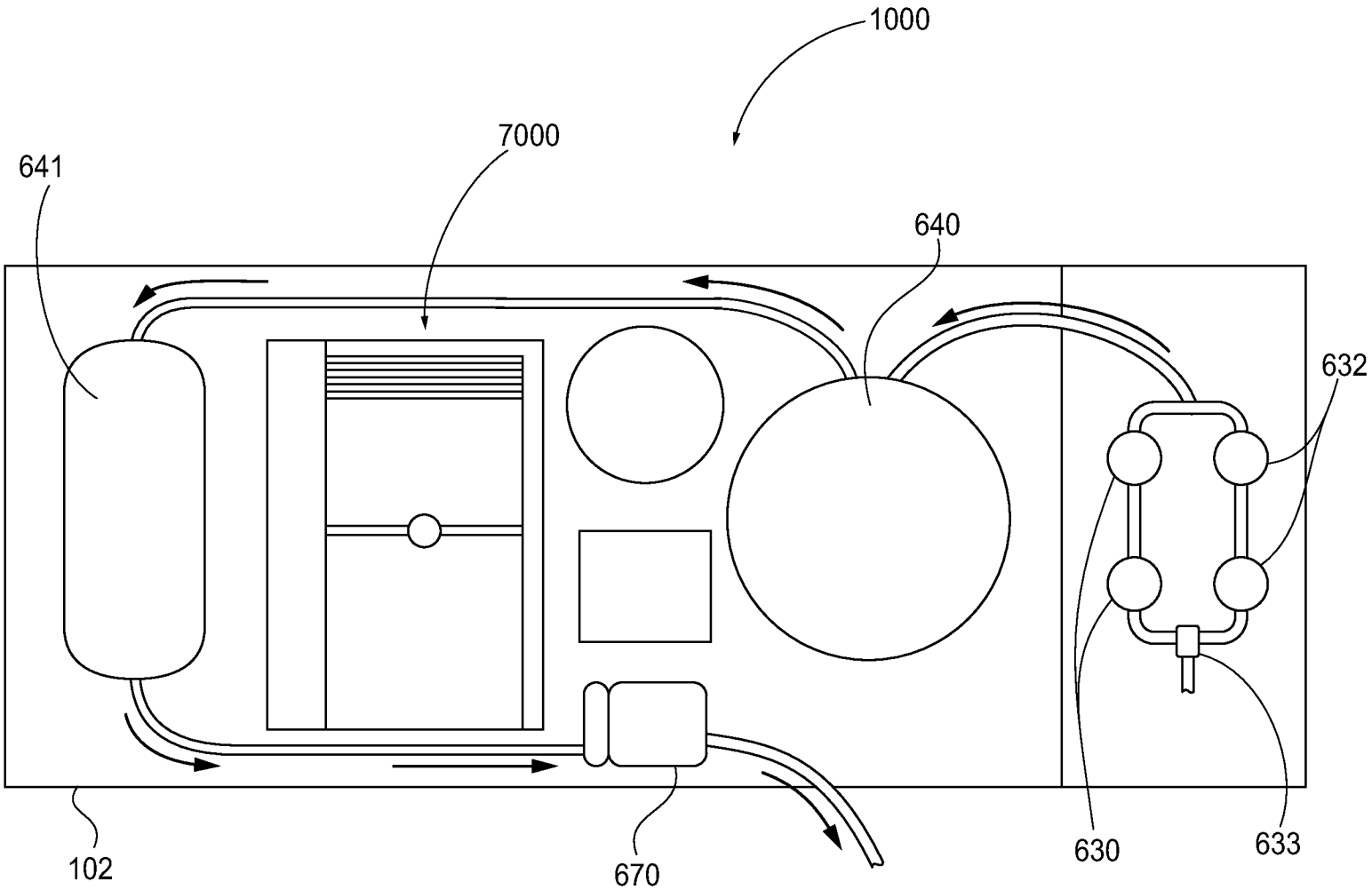
FIG. 12 is an overhead view of the portion of the water recycling system of FIG. 11.

Additional modular skids 102 may include additional components of the mat washer 1000, such as a central power unit 7000 (see FIGS. 11-12). According to the embodiment shown in the drawings, a total of two modular skids 102 contain all the necessary components of the mat washer 1000, such that the mat washer 1000 may be transported in two sections.

With continued reference to FIGS. 1-3, the mainframe 101 further includes a rail surface 105 having a receiving rack 103 incorporated at a first end of the rail surface 105, a washing chamber 108, a discharge wheel assembly 5000, and a discharge rack 109. One or more mats 8000 to be washed are loaded onto the receiving rack 103, translated along the rail surface 105 through the washing chamber 108 via a conveying system 2000, and deposited onto the discharge rack 109. The one or more mats 8000 may be loaded onto the receiving rack 103 with a front-end loader or any such capable equipment. In a non-limiting embodiment, the receiving rack 103 is constructed such that forks of a front-end loader or any such capable equipment carrying the one or more mats 8000 may be lowered onto the receiving rack 103 to facilitate easy loading of the one or more mats 8000.

The rail surface 105 is rigidly connected to the mainframe 101 and acts as a bearing surface between each mat 8000 and the mat washer 1000. The rail surface 105 is inclined at an angle of 25 degrees to 90 degrees from the horizontal so that water and debris may drain off of each mat 8000 and into the water recycling system 6000 (see FIGS. 8-10) located below the rail surface 105. A rail lip 106 attached substantially perpendicular to the rail surface 105 prevents each mat 8000 from sliding off of the rail surface 105. In a non-limiting embodiment, the rail surface 105 and the rail lip 106 are lined with ultra high molecular weight polyethylene (UHMW) or a similar low-friction, wear-resistant material.

A washing chamber 108 is affixed to the mainframe 101 adjacent to the receiving rack 103. A washing chamber enclosure 120 at least partially encloses the washing chamber 108 and minimizes the amount of water that can escape from the mat washer 1000. The washing chamber enclosure 120 has an entry orifice and an exit orifice through which each mat 8000 is conveyed into and out of the washing chamber, respectively. The entry orifice and exit orifice are covered by a plurality of bristles 121 (see FIG. 5), which allow each mat 8000 to pass through but substantially prohibit the exit of water from the washing chamber 108.

The discharge rack 109 is affixed to the opposite end of the mainframe 101 relative to the receiving rack 103. The discharge rack 109 includes a discharge surface 110 substantially parallel to the rail surface 105 onto which each mat 8000 is deposited and stacked by the discharge wheel assembly 5000. The discharge rack 109 further includes a discharge lip 111 substantially perpendicular to the discharge surface 110, which prevents each mat 8000 from sliding off of the discharge surface 110. The discharge surface 110 is lower than the rail surface 105 such that each mat 8000 deposited onto the discharge rack 109 by the discharge wheel assembly 5000 falls below the rail surface 105 and onto any mats 8000 already deposited on the discharge surface 110. In this manner, a stack of one or more mats 8000 is formed for easy offloading, for example, with a front-end loader or any such capable equipment. To facilitate the use of a front-end loader or any such capable equipment, the discharge rack 109 may be constructed such that forks of a front-end loader are easily inserted into the discharge rack 109 to lift the stack of one or more mats 8000 off of the discharge rack 109.

Figure 4:
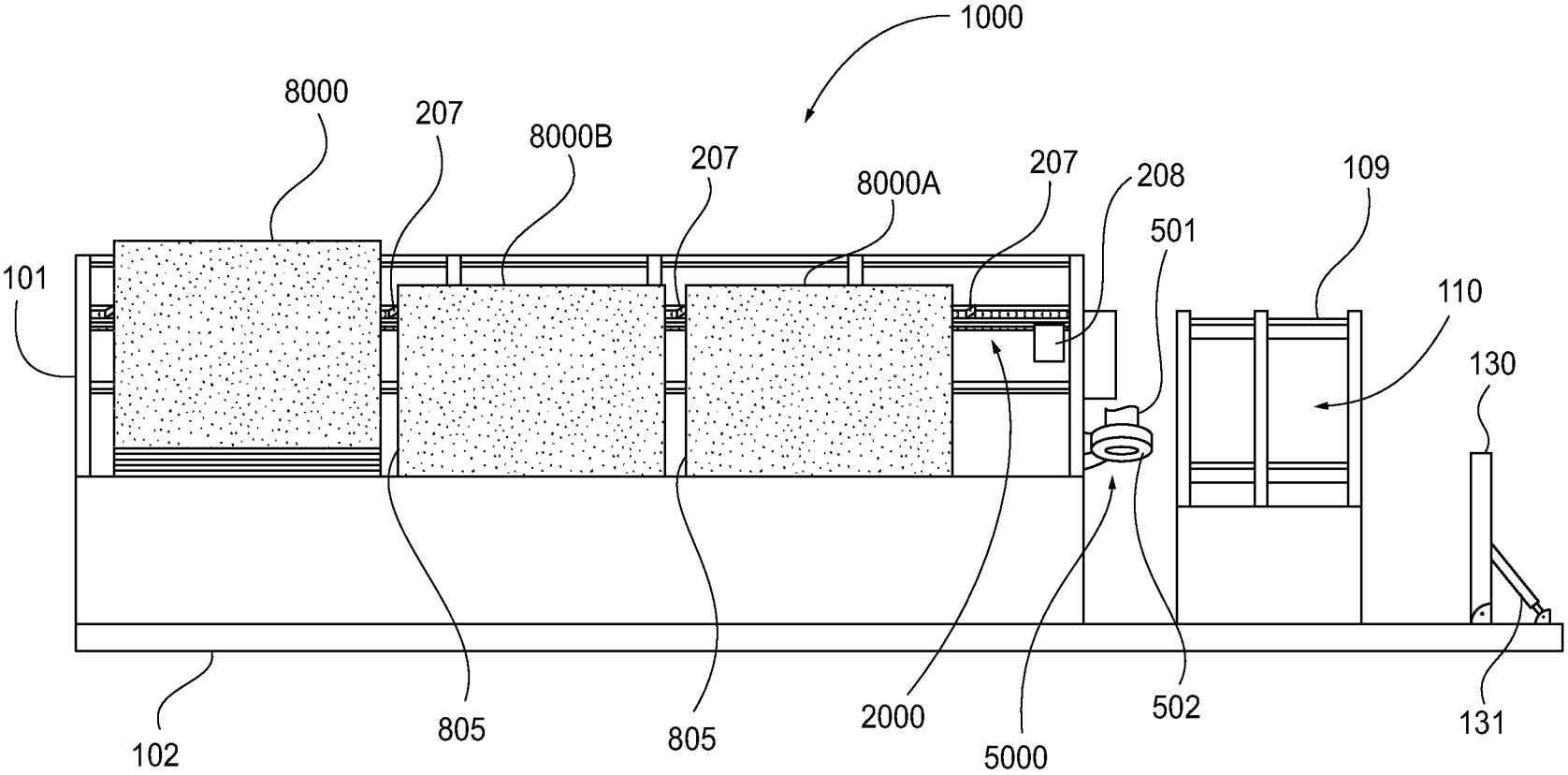
FIG. 4 is a front view of the mat washer of FIG. 1 loaded with a stack of mats.

With reference to FIGS. 3-4, a conveying system 2000 is adapted to translate each mat 8000, one at a time, along the rail surface 105 from the receiving rack 103 through the washing chamber 108. In a non-limiting embodiment, the conveying system 2000 is a chain drive. The conveying system 2000 includes an endless chain 203 wrapped around a drive sprocket 201 and a take-up sprocket 202. The drive sprocket 201 is coupled to a chain drive motor 208 which is affixed to the mainframe 101. The take-up sprocket 202 is rotatably attached to the mainframe 101, preferably via a tensioning device such as a coil spring to eliminate slack in the endless chain 203. In a non-limiting embodiment, the chain drive motor 208 is a hydraulic motor which receives hydraulic fluid from a hydraulic power unit. In a further non-limiting embodiment, the conveying system 2000 has an automatic shutoff switch at the take-up sprocket 202.

The endless chain 203 is composed of a plurality of interconnected links of conveyor chain which form an upper strand 204 and a lower strand 205. Interspersed along the endless chain 203 are one or more conveying tabs 207 which project outwardly from the conveying system 2000. Conveying tabs 207 on the upper strand 204 of the endless chain 203 protrude above the rail surface 105 to engage a rear edge 805 of a bottom mat 8000 in the receiving rack 103.

Referring now to FIG. 4, the conveying system 2000 is shown translating each of a stack of mats 8000 along the rail surface 105 from the receiving rack 103 towards the discharge wheel assembly 5000. The washing chamber 108 is not shown for clarity. In operation, the drive sprocket 201 is rotated by the chain drive motor 208, causing the endless chain 203 and the conveying tabs 207 attached thereto to cycle around the drive sprocket 201. The conveying tabs 207 engage the bottom mat 8000A in the stack, and pull the bottom mat 8000A towards the discharge wheel assembly 5000. Once the bottom mat 8000A has cleared the stack of mats 8000, the remaining mats 8000 in the stack drop onto rail surface 105.

As the conveying system 2000 pulls the bottom mat 8000A out of the receiving rack 103, each mat 8000 stacked on top of the bottom mat 8000A in the receiving rack 103 will have a tendency to be pulled forward along with the bottom mat 8000A. However, the entry orifice of the washing chamber 108 is only tall enough to permit one mat 8000 to pass into the washing chamber 108 at a time, such that any mats 8000 on top of the bottom mat 8000A are maintained in the receiving rack 103.

As the drive sprocket 201 continues to rotate, the next conveying tab 207 engages the second mat 8000B in the stack, and pulls the second mat 8000B towards the discharge wheel assembly 5000. This process is repeated until no mats 8000 remain in the receiving rack 103, or until another stop condition, such as the discharge rack 109 reaching full capacity, is present.

Figure 5:
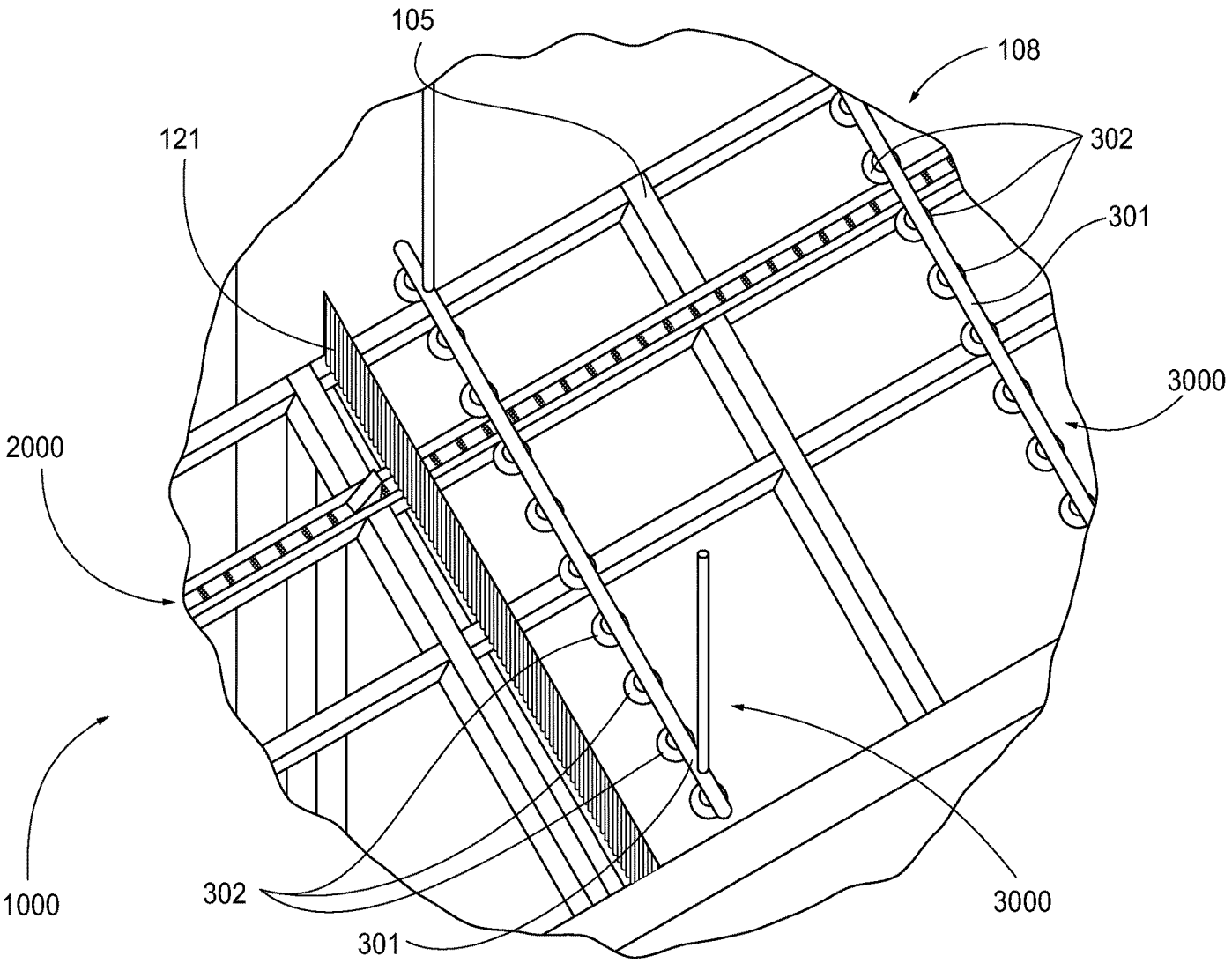
FIG. 5 is a perspective view of the inside of the washing chamber of the mat washer of FIG. 1.

Referring now to FIG. 5, the inside of the washing chamber 108 is shown with the washing chamber enclosure 120 removed for clarity. The washing chamber 108 includes one or more spray bars 3000 affixed to the mainframe 101. The one or more spray bars 3000 receive heated, pressurized water from the one or more high pressure pumps 670 and one or more high pressure filters 660 (see FIG. 9). Each of the one or more spray bars 3000 include a manifold pipe 301 connected to a plurality of spray nozzles 302 which direct jets of water at each mat 8000 conveyed through the washing chamber 108. The jets of water agitate and remove the debris from each mat 8000. At least one of the one or more spray bars 3000 is positioned above the rail surface 105 to direct water at the top surface 802 of each mat 8000. Additional spray bars 3000 may be positioned above or below the rail surface 105 to direct water at additional surfaces of each mat 8000. In a non-limiting embodiment, the plurality of spray nozzles 302 emit the jets of water in overlapping fans or circular patterns, to ensure that the entire top surface 802 and/or the entire bottom surface of each mat 8000 is contacted by the jets of water. In another non-limiting embodiment, the one or more spray bars 3000 are adjustable both in height and spray direction, thereby allowing an operator to optimize the plurality of spray nozzles 302 for cleaning of the mats 8000. The washing chamber 108 is enclosed by the washing chamber enclosure 120 (FIGS. 1-3) to contain and collect any overspray from the one or more spray bars 3000.

Figure 6:
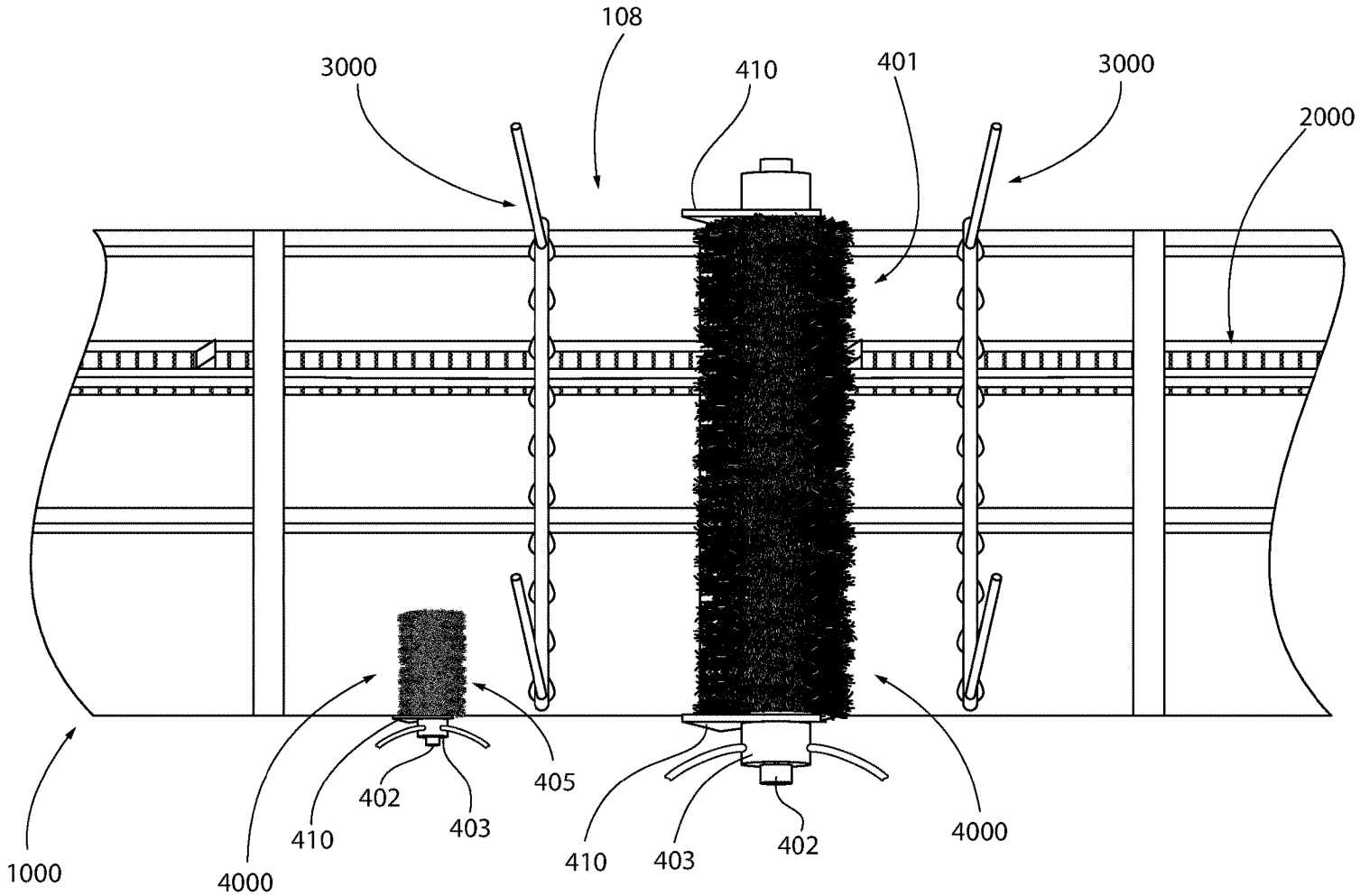
FIG. 6 is an overhead view of the brush assemblies according to an embodiment of the present invention.

Referring now to FIG. 6, in a non-limiting embodiment, the washing chamber 108 may further include one or more brush assemblies 4000. Each brush assembly 4000 includes a generally cylindrical drum brush 401 concentrically mounted to a brush shaft 402. Each brush assembly 4000 may be mounted above or below the rail surface 105 for cleaning the top surface 802 or bottom surface of the each mat 8000, respectively. A brush motor 403 is coupled to the brush shaft 402 of each brush assembly 4000 and rotates the corresponding drum brush 401 in a clockwise or counterclockwise direction to scrub debris from each mat 8000. In a preferred embodiment, the brush motor 403 of each of the brush assemblies is a hydraulic motor which receives hydraulic fluid from a hydraulic power unit.

Each drum brush assembly 4000 further includes at least one connecting arm 410 rotatably mounted to the brush shaft 402 by a roller bearing, for example. Each connecting arm 410 is attached to the mainframe 101 either rigidly or pivotally. Pivotal attachment to the mainframe 101 allows for control and adjustment of the proximity of each drum brush 401 to the rail surface 105. In this manner, the pressure exerted by each drum brush 401 on each mat 8000 may be adjusted as desired. For example, a spring may be disposed between the connecting arm 410 and mainframe 101 to increase or decrease the pressure applied by the drum brush 401 to each mat 8000. A shock absorber may be similarly employed between the connecting arm 410 and mainframe 101 to dampen vibration of the drum brush assembly 4000.

The drum brush 401 of at least one of the drum brush assemblies 4000 is at least as wide as a mat 8000, such that that drum brush 401 spans the entire width of each mat 8000 conveyed through the washing chamber 108.

Figure 13:
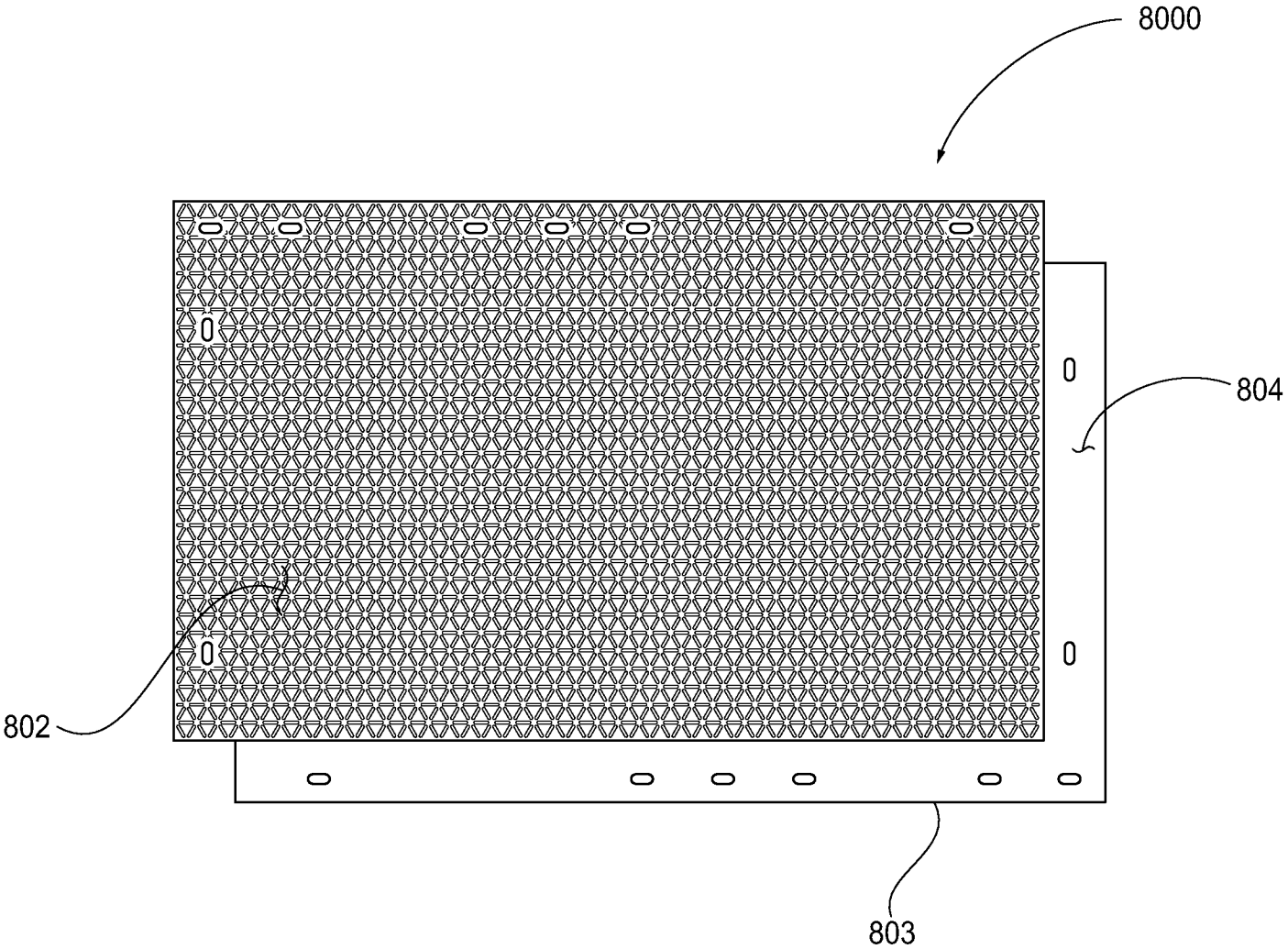
FIG. 13 is a top view of a mat for use with the mat washer of FIG. 1.

In a further non-limiting embodiment, the drum brush 401 of at least one of the drum brush assemblies 4000 is a lip brush 405, which is a dedicated brush for cleaning a recessed lip surface 804 of each mat 8000 (see FIG. 13). Mats 8000 of the type to be washed by the mat washer 1000 may have a lip 803 around the perimeter of the mat 8000, such that the lips 803 of two mats 8000 form an overlapping joint when the two mats 8000 are laid adjacent to one another. More specifically, the lip 803 of each mat 8000 is approximately half the thickness of the rest of the mat 8000. Consequently, a drum brush 401 which is applied against the top surface 802 or bottom surface of each mat 8000 may not apply sufficient pressure to the recessed lip surface 804 to adequately remove debris from the recessed lip surface 804. The at least one lip brush 405 primarily contacts the recessed lip surface 804 in order to scrub debris from the recessed lip surface 804 that the other drum brushes 401 cannot reach.

Figure 7:
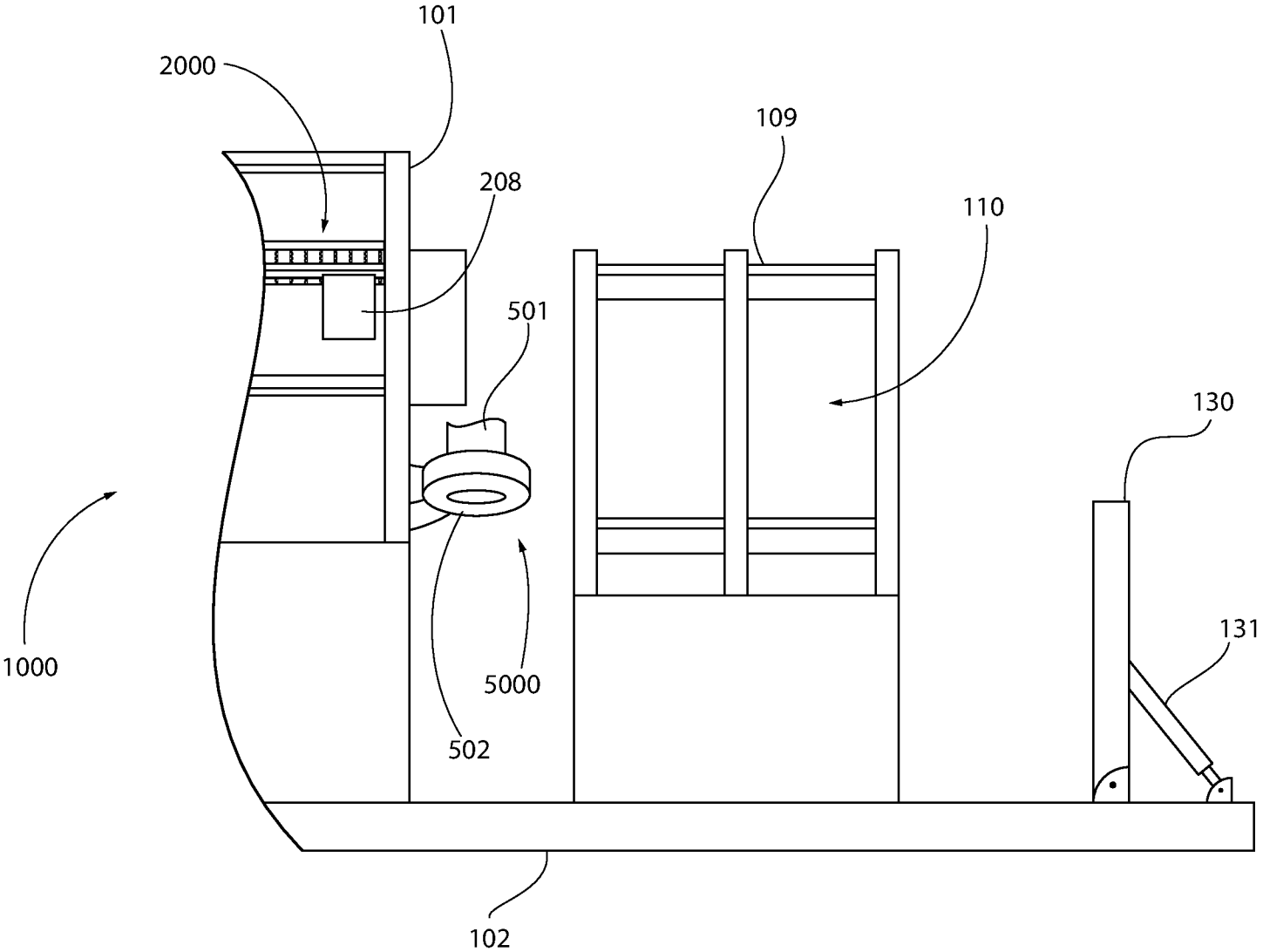
FIG. 7 is a front view of the discharge end of the mat washer of FIG. 1.

Referring now to FIG. 7, the discharge wheel assembly 5000 is affixed to the mainframe 101 between the washing chamber 108 and the discharge rack 109, and is adapted to propel each mat 8000 from the rail surface 105 onto the discharge rack 109. The discharge wheel assembly 5000 includes a discharge wheel motor 501 affixed to the mainframe 101 and a driven wheel 502 rotatably coupled to the discharge wheel motor 501. As the conveying system 2000 translates each mat 8000 through the washing chamber 108 and into proximity with the discharge wheel assembly 5000, the driven wheel 502 frictionally engages the bottom surface of the mat 8000 and the discharge wheel assembly 5000 propels the mat 8000 off of the rail surface 105 and onto the discharge rack 109. The velocity of the driven wheel 502 is faster than the velocity of the endless chain 203, so that the driven wheel 502 pulls each mat 8000 away from the endless chain 203.

The discharge wheel assembly 5000 may further include a gear reducer (not shown) coupled between the discharge wheel motor 501 and the driven wheel 502. In a preferred embodiment, the driven wheel 502 includes an automotive rim and tire. In a further preferred embodiment, the discharge wheel motor 501 is a hydraulic motor which receives hydraulic fluid from a hydraulic power unit.

With continued reference to FIG. 7, the discharge rack 109 includes a back brace 130 pivotally mounted to the mainframe 101. One or more shock absorbers 131 are pivotally mounted at a first end to the mainframe 101 and pivotally mounted at a second end to the back brace 130, such that the one or more shock absorbers 131 bias the back brace 130 to a substantially vertical position. The one or more shock absorbers 131 allow the back brace 130 to deflect and cushion the impact of each mat 8000 that is propelled onto the discharge rack 109 by the discharge wheel assembly 5000. The one or more shock absorbers 131 then return the back brace 130 to the substantially vertical position, pushing the mats 8000 on the discharge rack 109 into a neatly aligned stack.

Figure 8:
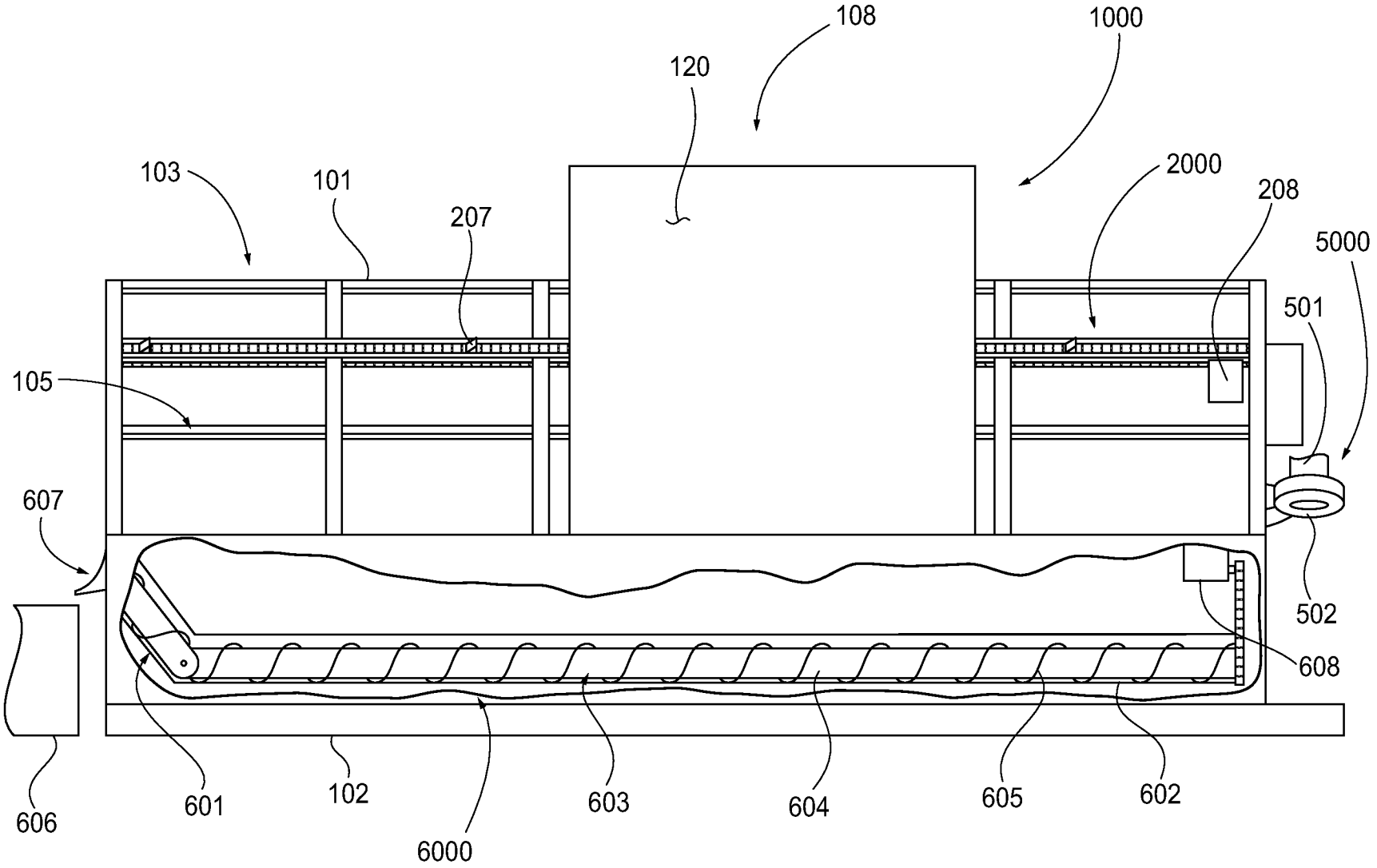
FIG. 8 is a front cutaway view of the waste conveyor of the mat washer of FIG. 1.
Figure 9:
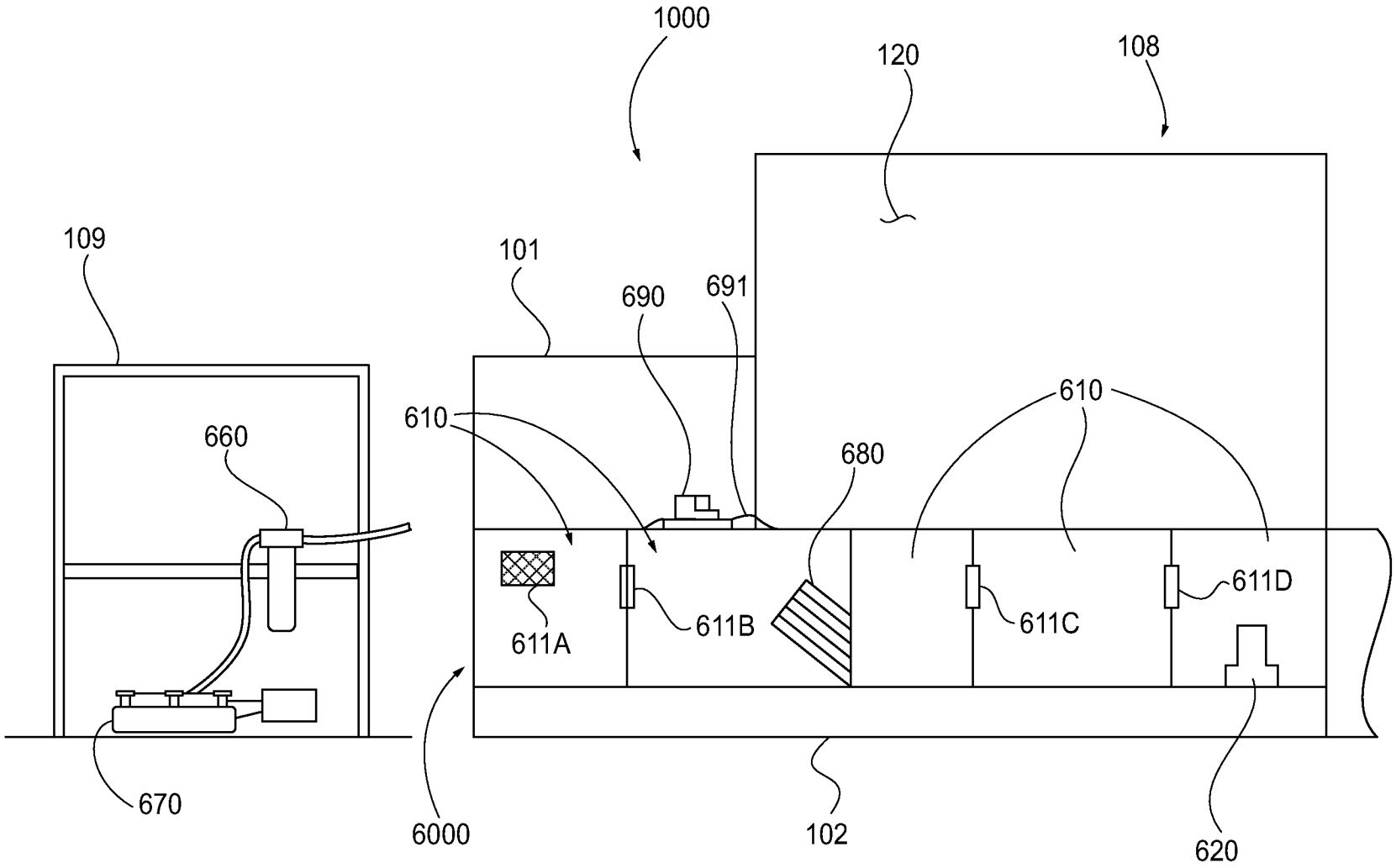
FIG. 9 is a rear view of a portion of the water recycling system of the mat washer of FIG. 1.
Figure 10:
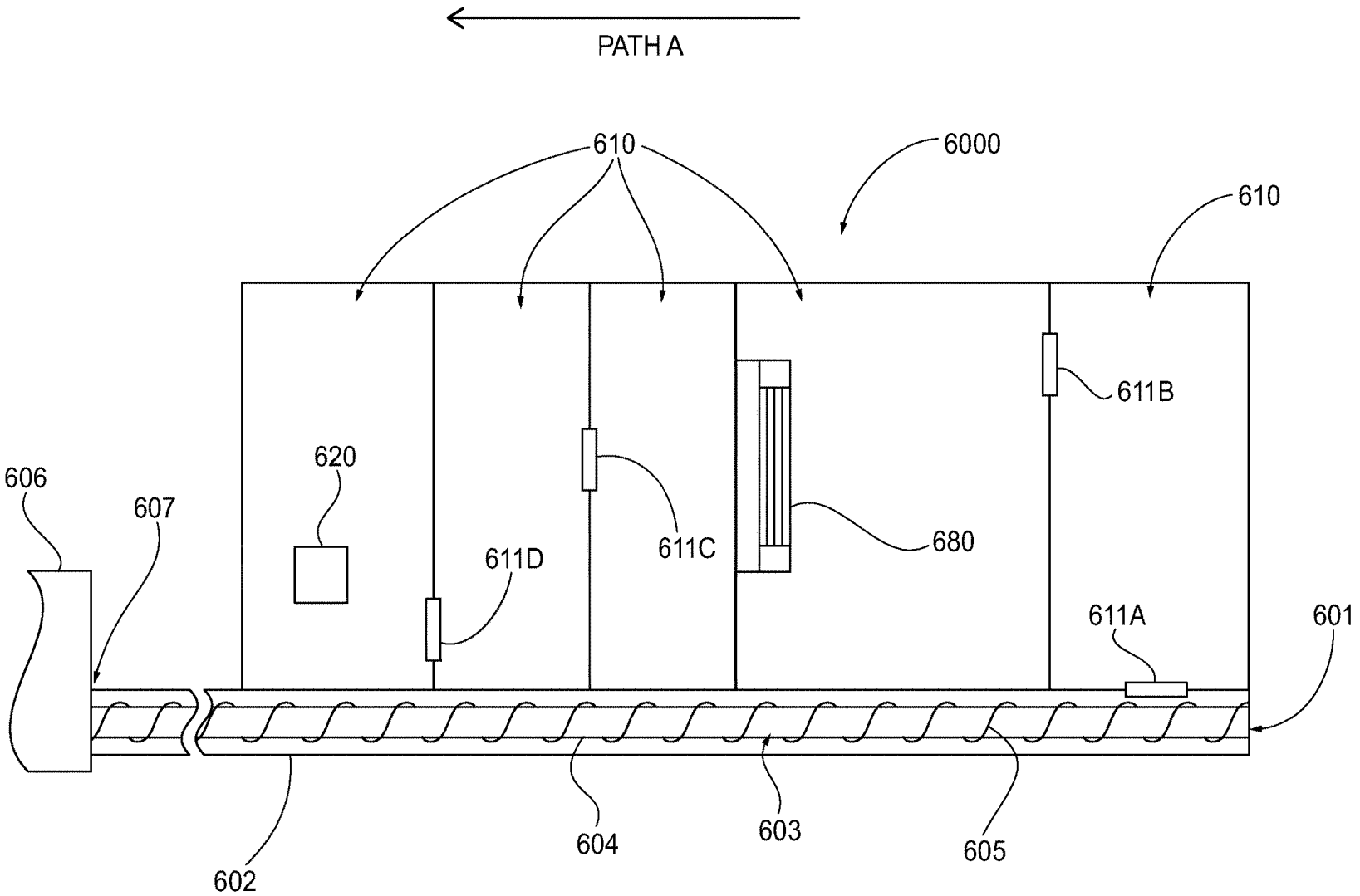
FIG. 10 is an overhead view of the portion of the water recycling system of FIG. 9.

Referring now to FIGS. 8-10, the mat washer 1000 includes a water recycling system 6000 located below the washing chamber 108. The water recycling system 6000 cleans and recirculates water used to wash the mats 8000 in order to reduce water consumption of the mat washer 1000. The water recycling system 6000 includes a waste conveyor 601 and one or more weir boxes 610. As the one or more spray bars 3000 wash debris from each mat 8000 conveyed through the washing chamber 108, the debris and water runs off of each mat 8000 into a trough 602. The debris is transported away from the washing chamber 108, out a discharge end 607, and into a waste bin 606 via the waste conveyor 601. The waste conveyor 601 includes an auger 603 disposed in the trough 602, and a waste conveyor motor 608 coupled to the auger 603. The auger 603 includes a longitudinal shaft 604 parallel to a rotational axis, and a helical or spiral screw blade 605 circumscribing the longitudinal shaft 604. As the waste conveyor motor 608 rotates the auger 603, the screw blade 605 engages debris in the trough 602 and drags the debris away from the washing chamber 108. Water is permitted to flow between the waste conveyor 601 and the trough 602 in a direction opposite the flow of debris and into the first of the one or more weirs 610. The discharge end 607 of the waste conveyor 601 is located above the water level of the one or more weir boxes 610 so that water cannot escape the discharge end 607. In a non-limiting embodiment, the auger 603 is composed of multiple sections, each section connected to the next by a universal joint.

Water and small debris exiting the washing chamber 108 are then gravity fed along Path A through the one or more weir boxes 610, which prohibit the passage of debris and thereby remove debris from the water. Each of the one of more weir boxes 610 includes a cavity having an entrance aperture and an exit aperture which permit flow into and out of the one or more weir boxes 610. Thus, water flows freely through the one or more weir boxes 610. However, debris settles to the bottom and becomes trapped in each of the one or more weir boxes 610. The debris which collects in the one or more weir boxes 610 must be periodically removed to maintain efficient operation of the mat washer 1000.

In a non-limiting embodiment, an oil separator 680 is included in at least one of the weir boxes 610. The oil separator 680 includes a plurality of parallel plates through which water must pass before exiting the one or more weir boxes 610. Oil particles trapped in the water coalesce on the underside of the parallel plates and form larger oil droplets as water passes through the parallel plates. Oil droplets of sufficient size become buoyant and therefore float to the surface of the water, from which they cannot flow into the next of the one or more weir boxes 610.

In another non-limiting embodiment, an oil skimmer 690 is attached to at least one of the weir boxes 610. The oil skimmer 690 includes an endless tube 691 engaged to a rotating drive wheel which cycles the endless tube 691 across the surface of the water in one of the one or more weir boxes 610. Floating contaminants, such as oil and hydraulic fluid, adhere to the endless tube 691, and are removed from the surface of the water as the endless tube 691 is cycled over the drive wheel. Near the drive wheel, one or more scrapers remove the contaminants from the endless tube 691 and direct the contaminants into a waste fluid bin.

In yet another non-limiting embodiment, the one or more weir boxes 610 include progressively finer screens 611A-611D disposed in the entrance and exit apertures to filter out debris. The weir box 610 located farthest upstream Path A has a coarsest screen 611A which allows relatively large debris to pass through it relative to the other screens 611B-611D. The weir box 610 located farthest downstream Path A has a finest screen 611D which allows relatively small debris to pass through it relative to the other screens 611A-C. Water and debris which passes through all of the plurality of weir boxes 610 is pumped via a transfer pump 620 to the remainder of water recycling system 6000.

Referring now to FIGS. 11-12, the water recycling system 6000 further includes a first plurality of filtration devices 630, a holding tank 640, and one or more boilers 641. Water from the transfer pump 620 first reaches the first plurality of filtration devices 630. The first plurality of filtration devices 630 remove debris from the water which are too small to be removed by the screens 611A-D, but are too large to safely pass through one or more boilers 641 or the one or more spray bars 3000. Each of the plurality of filtration devices 630 has a progressively finer filtration medium than the filtration device 630 preceding it.

In a non-limiting embodiment, a second plurality of filtration devices 632 are included, along with a diverter valve 633. The diverter valve 633 is a manually switchable flow control device adapted such that an operator can select whether water flows through the first plurality of filtration devices 630 or the second plurality of filtration devices 632. This allows the operator to shut down the first plurality of filtration devices 630 for maintenance while the second plurality of filtration devices 632 remain in service, or vice versa.

In another non-limiting embodiment, the first plurality of filtration devices 630 and the second plurality of filtration devices 632 are basket strainers having replaceable bag filters as filtration media. For example, the first plurality of filtration devices 630 and the second plurality of filtration devices 632 may each include two basket strainers having ratings of 200 microns and 100 microns, respectively. In a further non-limiting embodiment, each of the basket strainers include a gauge which indicates when the filtration media of that basket strainer needs to be changed.

With continued reference to FIGS. 11-12, after flowing through the first plurality of filtration devices 630 and/or the second plurality of filtration devices 632, the recycled water flows into the holding tank 640 mounted to the mainframe 101. One or more high pressure pumps 670 pump the water from the holding tank 640 through one or more boilers 641, through one or more high pressure filters 660 (see FIG. 9), and then to the one or more spray bars 3000. In this manner, the one or more spray bars 3000 receive a continuous flow of heated, pressurized water from the water recycling system 6000.

The one or more boilers 641 are mounted to the mainframe 101 and heat the water up to a washing temperature, for example, 140 degrees Fahrenheit. In a non-limiting embodiment, each of the one or more boilers 641 includes a diesel burner, a plurality of coiled tubes through which the water circulates, and a blower which circulates hot air from the diesel burner across the plurality of coiled tubes, thereby heating the water within the plurality of coiled tubes.

The one or more high pressure filters 660 remove any remaining debris from the pressurized water before the pressurized water enters the one or more spray bars 3000. Each of the one or more high pressure filters 660 may be, for example, a cleanable, reusable stainless steel cartridge filter rated between 200 and 500 microns. The one or more high pressure filters 660 may be isolated in a manner similar to that of the first and second pluralities of filtration devices 630, 632. That is, the operator may shut down a first high pressure filter 660 for maintenance while a second high pressure filter 660 remains in service, or vice versa.

Further, the one or more high pressure filters 660 need not be in close proximity to one another. For example, the one of more high pressure filters 660 may be allocated between both of the modular skids 102. Similarly, the one or more high pressure pumps 670 may be arranged between the modular skids 102 and between different components of the water recycling system 6000. For example, in the embodiment shown in the drawings, a pair of high pressure pumps 670 (including one spare) feeds the one or more boilers 641, and a third high pressure pump 670 is located under the discharge rack 109 in closer proximity to the one or more spray bars 3000 (see FIG. 9).

In a non-limiting embodiment, the chain drive motor 208, the discharge wheel motor 501, and the waste conveyor motor 608 are each hydraulic motors. A central power unit 7000 including a diesel motor and a main gearbox having a plurality of outputs is mounted to the mainframe 101. A first output of the main gearbox may be coupled to a hydraulic pump which supplies hydraulic fluid to the chain drive motor 208, the discharge wheel motor 501, and the waste conveyor motor 608. A second output of the main gearbox may provide hydraulic power to the one or more high pressure pumps 670. A third output of the main gearbox may be coupled to the transfer pump 620 and an electric generator. A diesel fuel tank, which provides fuel to the diesel engine and the one or more boilers 641, is also mounted to the mainframe 101.

In a non-limiting embodiment, the mat washer 1000 is automated and may be operated remotely, for example, by a control device located inside a front-end loader or any such capable equipment. In this manner, the manpower and time required to operate the mat washer 1000 is further reduced.

In a further non-limiting embodiment, the mat washer 1000 includes a system of limit switches to further automate the mat washing process by stopping the conveying system 2000 when a predetermined number of mats 8000 have been washed. A first limit switch, which may be a ball detent, is located on the discharge rack 109 such that the first limit switch detects when the predetermined number of mats 8000 has been deposited on the discharge rack 109. A second limit switch may be located alongside the rail surface 105 before the discharge wheel 5000 such that the second limit switch detects each mat 8000 that passes through the washing chamber 108. When the first limit switch detects that the predetermined number of mats 8000 has been deposited in the discharge rack 109, and the second limit switch detects that another mat 8000 is on the rail surface 105, the conveying system 2000 automatically stops so that the mats 8000 in the discharge rack 109 may be safely unloaded before additional mats 8000 are deposited on the discharge rack 109.

While various embodiments of mat washers are shown in the accompanying drawings and described hereinabove in detail, other examples will be apparent to, and readily made by, those skilled in the art without departing from the scope and spirit of the invention. For example, it is to be understood that this invention contemplates that, to the extent possible, one or more features of any embodiment may be combined with one or more features of any other embodiment. Accordingly, the foregoing description is intended to be illustrative rather than restrictive.

The invention claimed is:

1. A mat washer, comprising:

a mainframe;

a rail surface affixed to said mainframe;

a conveying system affixed to said mainframe, said conveying system adapted to translate one or more mats along said rail surface;

a washing chamber affixed to said mainframe, said washing chamber at least partially enclosing said rail surface such that said conveying system translates each of said one or more mats through said washing chamber;

one or more spray bars disposed within said washing chamber, each of said one or more spray bars having a plurality of nozzles adapted to direct jets of water at each of said one or more mats translated through said washing chamber;

a water recycling system disposed in said mainframe adapted to collect runoff from said washing chamber, said water recycling system comprising:

a waste conveyor adapted to separate large debris from water, one or more filtration devices adapted to separate small debris from water, and an oil-water separator adapted to inhibit a flow of oil particles, causing said oil particles to float to a water surface;

a high pressure pump disposed between said water recycling system and said one or more spray bars, said high pressure pump supplying water under pressure to said one or more spray bars; and one or more water boilers through which water exiting said one or more filtration devices is pumped and in which water is heated to a washing temperature.

2. The mat washer of claim 1, further comprising one or more high pressure filters disposed between said water recycling system and said one or more spray bars.

3. The mat washer of claim 1, further comprising:

a discharge wheel affixed to said mainframe between said washing chamber and a discharge rack, said discharge wheel adapted to propel each of said one or more mats onto said discharge rack forming a stack of mats; and at least one shock absorber affixed to said discharge rack, said at least one shock absorber adapted to cushion the impact between each of said one or more mats and said discharge rack.

4. The mat washer of claim 1, further comprising one or more brush assemblies disposed within said washing chamber, each of said one or more brush assemblies having a rotating drum brush adapted to scrub a surface of each of said one or more mats.

5. The mat washer of claim 4, wherein at least one of said one or more drum brush assemblies is dedicated to scrub a recessed lip surface on each of said one or more mats.

6. The mat washer of claim 1, wherein the mainframe is comprised of a plurality of modular skids such that the mat washer may be transported in sections.

7. The mat washer of claim 1, wherein the rail surface is lined with ultra high molecular weight polyethylene.

8. The mat washer of claim 1, wherein the mat washer is controlled via a remote control positioned in a cabin of a piece of loading equipment.

9. The mat washer of claim 1, wherein the conveying system is a chain drive comprising:

a drive sprocket;

a take-up sprocket;

an endless chain wrapped around said drive sprocket and said take-up sprocket;

one or more tabs projecting from said endless chain, said one or more tabs adapted to engage a rear edge of each of said one or more mats; and a chain drive motor coupled to said drive sprocket.

10. The mat washer of claim 1, wherein said oil-water separator comprises a plurality of parallel plates.

11. The mat washer of claim 1, wherein said rail surface is affixed to said mainframe at an angle of 25 degrees to 90 degrees.

12. A mat washer comprising:

a mainframe;

a rail surface affixed to said mainframe;

a conveying system affixed to said mainframe, said conveying system adapted to translate one or more mats along said rail surface;

a washing chamber affixed to said mainframe, said washing chamber at least partially enclosing said rail surface such that said conveying system translates each of said one or more mats through said washing chamber;

one or more spray bars disposed within said washing chamber, each of said one or more spray bars having a plurality of nozzles adapted to direct jets of water at each of said one or more mats translated through said washing chamber;

a water recycling system disposed in said mainframe adapted to collect runoff from said washing chamber, said water recycling system comprising:

a waste conveyor adapted to separate large debris from water, one or more filtration devices adapted to separate small debris from water, and an oil skimmer which removes said oil particles from the water surface and deposits said oil particles into a waste oil bin;

a high pressure pump disposed between said water recycling system and said one or more spray bars, said high pressure pump supplying water under pressure to said one or more spray bars; and one or more water boilers through which water exiting said one or more filtration devices is pumped and in which water is heated to a washing temperature.

13. The mat washer of claim 12, wherein said oil skimmer comprises an endless tube which cycles across the water surface.

* * * * *